US008689478B2

(12) United States Patent
Patel

(10) Patent No.: US 8,689,478 B2
(45) Date of Patent: Apr. 8, 2014

(54) QUICK TAKE-DOWN BARREL SYSTEM AND METHOD FOR MODULAR RIFLE

(76) Inventor: Swetal K. Patel, Dallas, GA (US)

( * ) Notice: Subject to any disclaimer, the term of this patent is extended or adjusted under 35 U.S.C. 154(b) by 184 days.

(21) Appl. No.: 13/372,699

(22) Filed: Feb. 14, 2012

(65) Prior Publication Data

US 2013/0205637 A1 Aug. 15, 2013

(51) Int. Cl.
*F41A 21/00* (2006.01)

(52) U.S. Cl.
USPC ..... 42/75.02

(58) Field of Classification Search
USPC ..... 42/75.02
See application file for complete search history.

(56) References Cited

U.S. PATENT DOCUMENTS

| | | | | |
|---|---|---|---|---|
| 1,373,888 | A * | 4/1921 | Johnson | 42/75.02 |
| 2,951,424 | A | 9/1960 | Stoner | |
| 4,358,987 | A | 11/1982 | Wilhelm | |
| 5,020,260 | A * | 6/1991 | Houghton | 42/75.02 |
| 6,959,509 | B2 | 11/2005 | Vais | |
| 7,574,823 | B2 | 8/2009 | Nakayama | |
| 7,905,041 | B1 * | 3/2011 | Davies | 42/75.02 |
| 8,046,949 | B1 * | 11/2011 | Daniel | 42/75.02 |
| 8,051,595 | B2 * | 11/2011 | Hochstrate et al. | 42/75.01 |
| 8,087,194 | B1 * | 1/2012 | Vuksanovich | 42/75.02 |
| 8,276,304 | B2 * | 10/2012 | Samson et al. | 42/75.02 |
| 8,448,367 | B2 * | 5/2013 | Samson et al. | 42/75.02 |
| 2006/0260169 | A1 * | 11/2006 | Samson et al. | 42/72 |
| 2009/0277067 | A1 | 11/2009 | Gregg | |
| 2012/0017483 | A1 * | 1/2012 | Vuksanovich | 42/75.02 |
| 2012/0131835 | A1 * | 5/2012 | Barrett et al. | 42/75.02 |
| 2012/0186123 | A1 * | 7/2012 | Troy et al. | 42/71.01 |

* cited by examiner

*Primary Examiner* — Samir Abdosh
(74) *Attorney, Agent, or Firm* — Thomas | Horstemeyer, LLP

(57) ABSTRACT

In embodiments, a modular rifle includes a lower receiver assembly, an upper receiver assembly housing a barrel, and a coupling mechanism. Upper receiver assembly has two portions, an aft portion and fore portion, commonly comprising a hand guard. The barrel is releasably attached to the upper receiver first portion by a hand-tightenable barrel nut sleeve connector. Upper receiver second portion is both releasably attached to the barrel nut connector sleeve and to the upper receiver first portion to prevent the barrel nut connector sleeve from rotating during firing of the rifle and to keep the second portion from detaching during firing of the rifle. Attachment of upper receiver second portion to the barrel nut connector sleeve is accomplished by a removable take-down pin and common screw clamp, which secure the barrel nut connector sleeve. Upper receiver first and second portions are connected by an attachment tab and receptacle.

10 Claims, 4 Drawing Sheets

116
103
102
110
112
115
118
108
117
105
114
101
119

115
102
118
108
117
105
114
101
119

115
102
118
108
105
106
114
101
119

QUICK TAKE-DOWN BARREL SYSTEM AND METHOD FOR MODULAR RIFLE

BACKGROUND OF THE INVENTION

A rifle is a type of weapon that fires rounds. Typically, the rifle includes a trigger, a hammer, and a barrel. The round is positioned in the barrel, and, when the trigger is pulled, the hammer fires the round through the barrel. A modular rifle typically includes a lower receiver assembly, an upper receiver assembly housing the barrel, and a coupling mechanism. The M-16 style rifle is a type of modular rifle system commonly used by military and police forces that features a gas-operated bolt and bolt carrier system, as disclosed, for example, in U.S. Pat. No. 2,951,424, issued to Eugene M. Stoner on Sep. 6, 1960 (incorporated herein by reference in its entirety). The AR-15 style rifle is a similarly designed modular rifle system commonly sold and used in civilian applications.

For most M-16/AR-15 style rifle systems, the barrel is assembled by connecting the barrel to the upper receiver utilizing a barrel nut. The barrel nut must be appropriately torqued to properly align the barrel and completely tighten the barrel nut, typically requiring the use of specialized tools and a bench vise. Consequently, the barrel cannot be quickly or easily removed, changed, or assembled in the field under combat conditions or exigent circumstances, and the rifle system cannot be quickly and easily stored in a disassembled state.

Providing a system and method for allowing the barrel to be assembled and the barrel nut to be properly tightened by hand, in the field, and without any specialized bench tools or a vise, provides for rapid changing of the barrel, assembly/disassembly of the rifle system, and storing of the rifle system.

SUMMARY

In embodiments, this new system and method would allow for quick assembly and disassembly of M-16/AR-15 style modular rifle systems and simple, rapid changing of the barrel assembly. In order to avoid the need for specialized tools and a bench vise to remove the barrel assembly, the barrel assembly is inserted into a first portion of the upper receiver by hand. The barrel nut connector sleeve is screwed onto the threads in the upper receiver assembly, and the barrel nut connector sleeve is tightened by hand force only.

In embodiments, to keep the barrel nut connector sleeve from rotating off the first portion of the upper receiver assembly during firing of the rifle, a second portion of the upper receiver, a hand guard portion, is attached with a male/female tab at the 12 o'clock position so as to keep the hand guard portion from rotating during firing of the rifle. The hand guard portion is attached to the barrel nut connector sleeve by a cross-screw clamp, which compresses the open machined slot at the 6 o'clock position on the hand guard portion. This keeps the barrel nut connector sleeve from rotating due to the pressure applied by the hand guard portion of the upper receiver on the outer diameter of the barrel nut connector sleeve.

In embodiments, a groove is machined in the outside diameter of the barrel nut connector sleeve through which a pin or simple shoulder screw is inserted, further keeping the hand guard portion from traveling forward along the barrel toward the muzzle during firing of the rifle. In this manner, the barrel assembly remains properly and securely attached to the upper receiver assembly of the rifle system.

In embodiments, the securing of the barrel assembly to the upper receiver assembly can be accomplished in the field without any specialized tools, providing a distinct advantage to military and law enforcement personnel in combat conditions or conflict situations and to other users needing the ability to quickly assemble, disassemble or store the rifle system in a compact fashion.

It should be emphasized that the above-described embodiments of the present invention, particularly, any "preferred" embodiments, are merely possible examples of implementations, merely set forth for a clear understanding of the principles of the invention. Other systems, devices, methods, features, and advantages of the disclosed system and method include variations and modifications apparent or that may become apparent to one of skill in the art upon examination of the following figures and detailed description, without departing substantially from the spirit and principles of the invention. All such modifications and variations are intended to be included within this description and are intended to be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
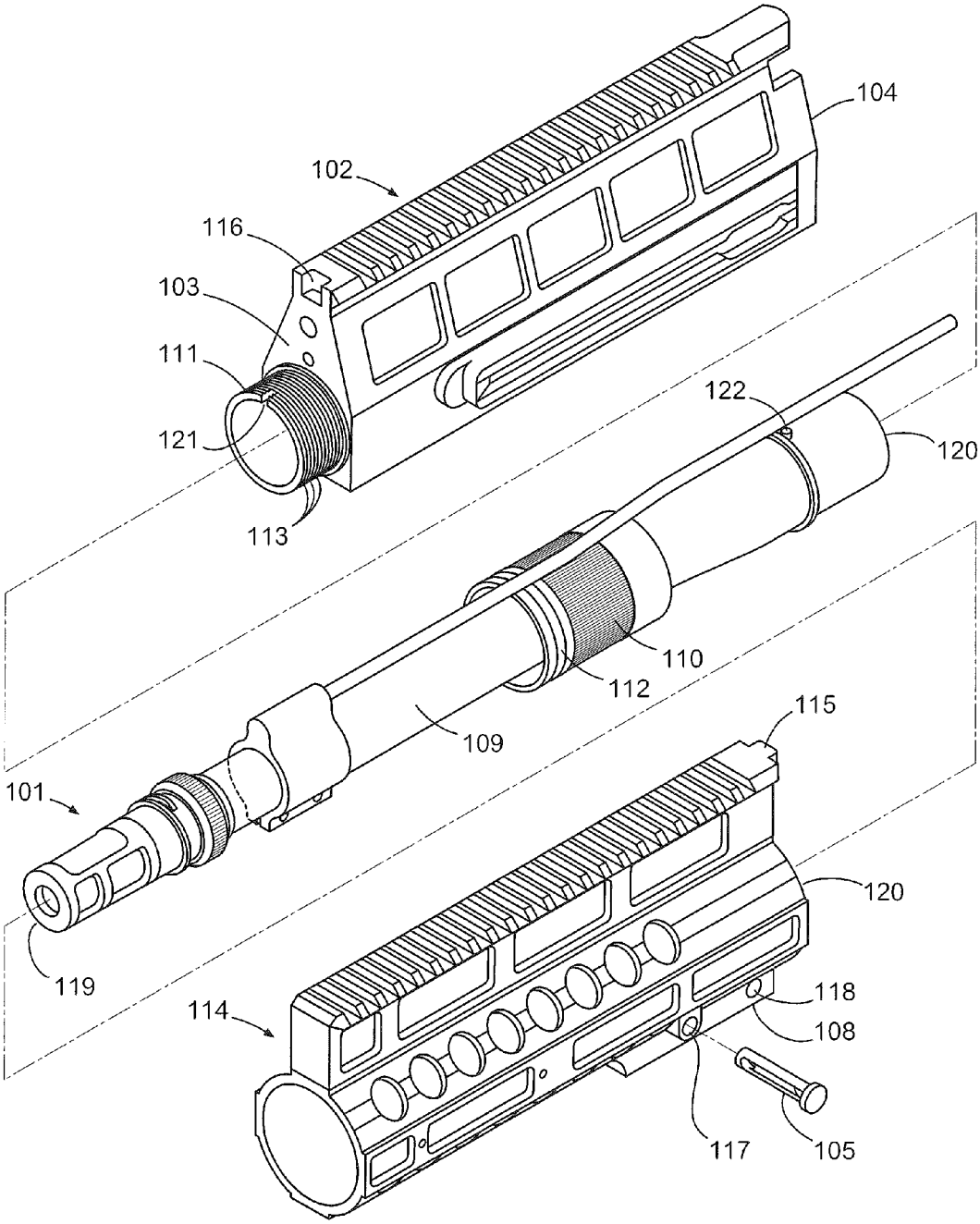
FIG. 1 is an exploded perspective view of two portions of an upper receiver assembly and a barrel assembly in accordance with one exemplary embodiment of the present invention.
Figure 2A:
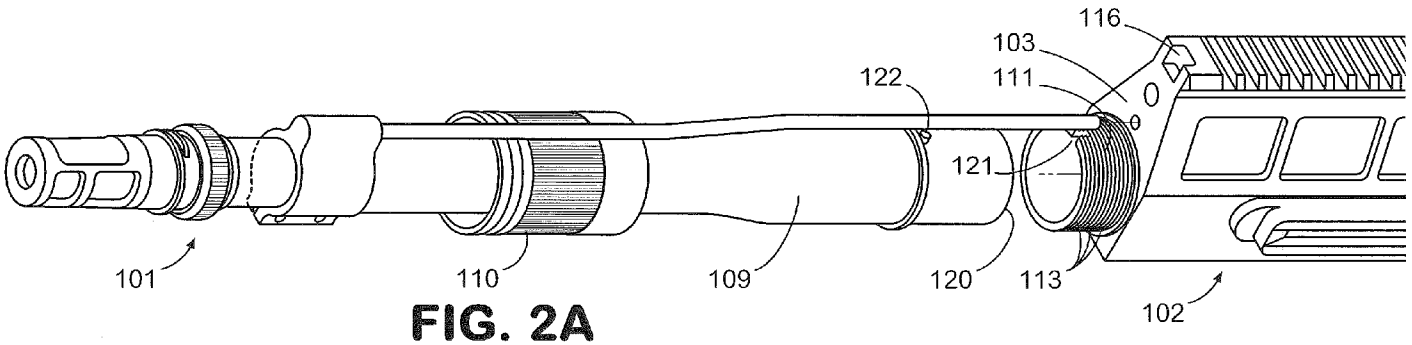
FIG. 2 is a perspective view of the progression of the assembly of the first and second portions of the upper receiver and the barrel assembly, in accordance with one exemplary embodiment of the present invention, utilizing the components featured in FIG. 1.
Figure 2B:
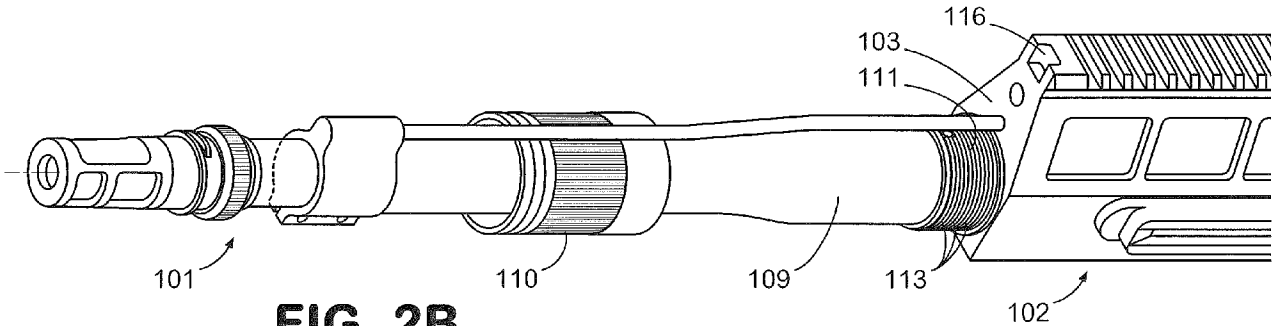
Figure 2C:
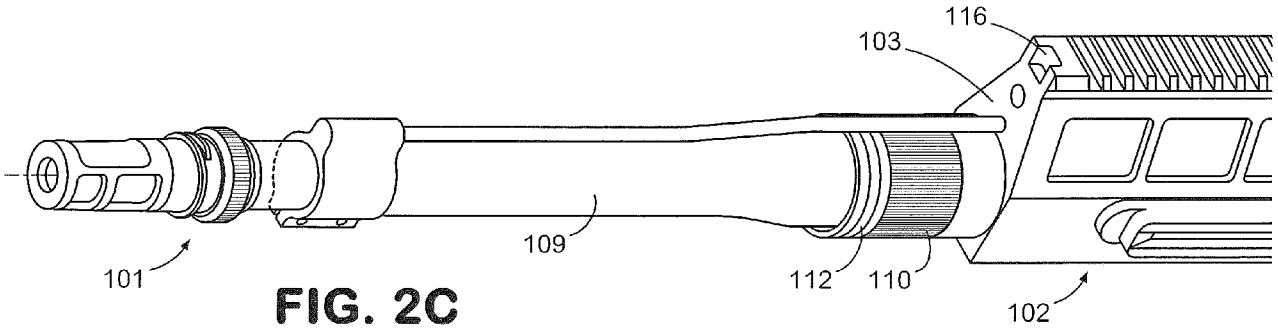
Figures 2D, 2E, 2F:
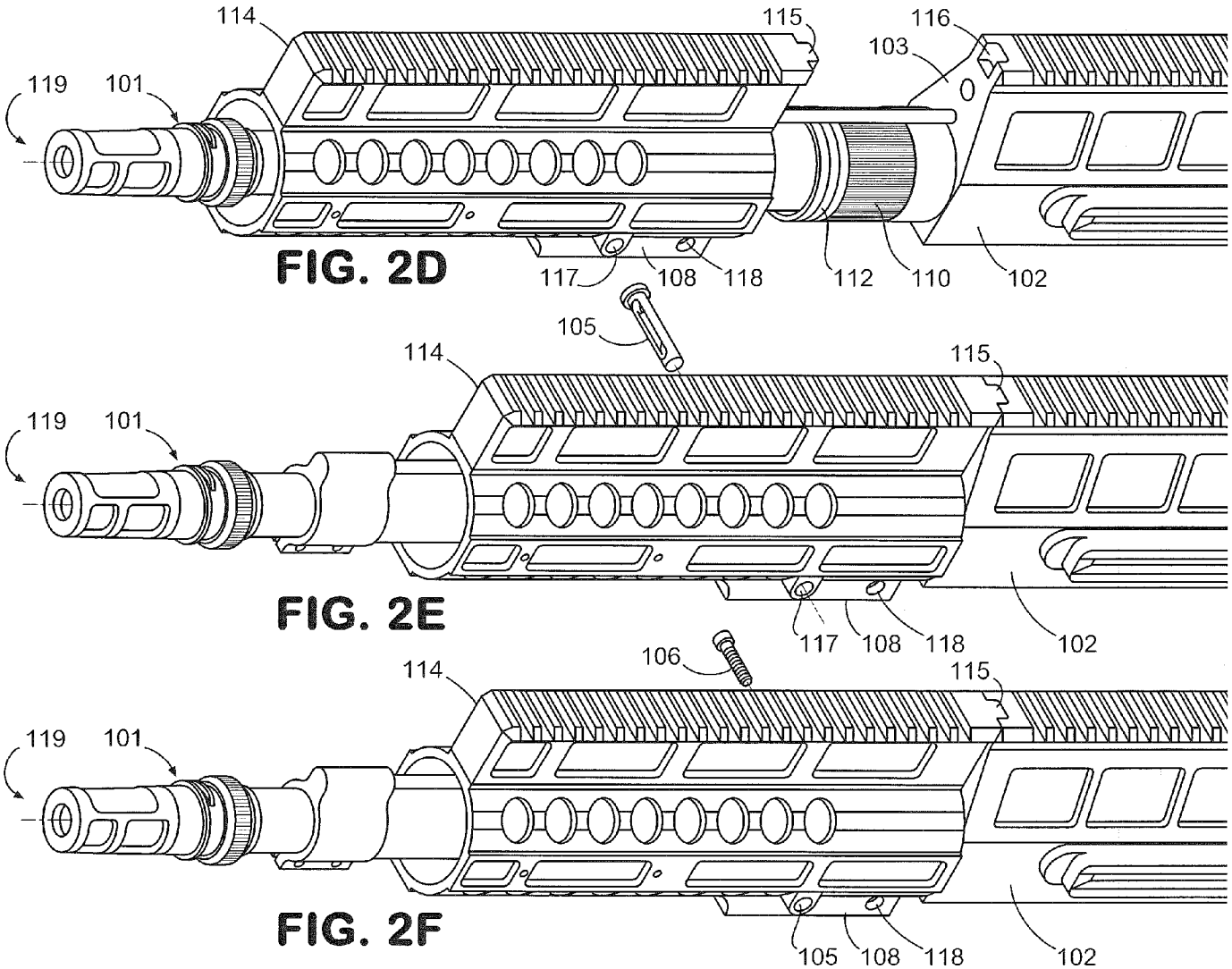

Disclosed below are embodiments of a quick take-down barrel system and methods for a modular rifle system. FIG. 1 is a perspective view of a fore 114 and aft 102 portions of an upper receiver assembly and a barrel assembly 101 in accordance with one exemplary embodiment of the present invention. Barrel assembly 101 is affixed to the front face 103 of aft portion 102 of upper receiver assembly by means of a threaded barrel nut connector sleeve 110. Aft portion 102 of upper receiver assembly and barrel assembly 101 are coupled to a fore portion 114 of upper receiver assembly, comprising a hand guard, by means of a takedown pin 105, an alignment tab 115, and a slotted screw clamp 108.

With reference to FIG. 1, aft portion 102 of upper receiver assembly is comprised of a forward face 103 and a rearward face 104. Forward face 103 of aft portion 102 of upper receiver assembly contains a nipple 111 with circumferential machined threads 113 around its outer diameter and an alignment tab receiver compartment 116. The fore portion 114 of upper receiver assembly, comprising a hand guard, contains an alignment tab 115, a take-down pin receptacle port 117, and a slotted clamp 108 with clamp screw receptacle port 118. Barrel assembly 101 is comprised of barrel 109 and threaded barrel nut connector sleeve 110.

FIG. 2 is a perspective view of the progression of the assembly of the fore 114 and aft 102 portions, respectively, of the upper receiver assembly and barrel assembly 101 in accordance with one exemplary embodiment of the present invention, utilizing the components featured in FIG. 1. With reference to FIG. 2, in affixing the barrel assembly 101 to the aft portion 102 of the upper receiver assembly, barrel assembly 101 is aligned with the aft portion 102 of the upper receiver assembly, such that the rearward end 120 of the barrel 109 is aligned with threaded nipple 111 on the forward face 103 of aft portion 102 of upper receiver assembly. Rearward end 120 of barrel assembly 101 is inserted into the inside diameter of threaded nipple 111 on forward face 103 of aft portion 102 of upper receiver assembly. In some applications, standard barrel assemblies may contain a barrel alignment pin 122 at the 12 o'clock position on along the outer diameter of aft segment of barrel 109, which pin can be accommodated in emodiments by a corresponding barrel alignment slot 121 at the 12 o'clock position on the front edge of threaded nipple 111. Threaded barrel nut connector sleeve 110 is threaded onto threads 113 on the outside diameter of threaded nipple 111 on forward face 103 of aft portion 102 of upper receiver assembly and tightened by hand to secure barrel assembly 101 to aft portion 102 of upper receiver assembly. Fore portion of upper receiver assembly 114, in some embodiments comprising a hand guard, is aligned with aft portion 102 of upper receiver assembly such that forward end 119 of barrel assembly 101 is fed through rearward portion 128 of fore (hand guard) portion 114 of upper receiver assembly. Aft portion 102 of upper receiver assembly and fore (hand guard) portion 114 of upper receiver assembly are joined by aligning alignment tab 115 with alignment tab receptacle port 116 and inserting alignment tab 115 into alignment tab receiver compartment 116. Take-down pin 105 is inserted through takedown pin receptacle port 117 such that take-down pin 105 rests within the interior concaved aperture of one or more grooves 112 machined into barrel nut connector sleeve 110, the insertion of take-down pin 105 thereby preventing fore (hand guard) portion 114 of upper receiver assembly from traveling forward along the longitudinal axis of the barrel assembly 101 when the rifle system is fired. Juncture of fore (hand guard) portion 114 of upper receiver assembly and aft portion 102 of upper receiver assembly is secured by a clamp screw 106 inserted in a slotted clamp screw receptacle port 118 within the slotted clamp 108 on the bottom face of fore (hand guard) portion 114 of upper receiver assembly, wherein the tightening of clamp screw 106 compresses slotted clamp 108, and the resulting pressure on barrel nut connector sleeve 110 from compression of clamp 108 prevents barrel nut connector sleeve 110 from rotating on nipple threads 113 of aft portion 102 of upper receiver assembly when the rifle system is fired.

Figure 3:
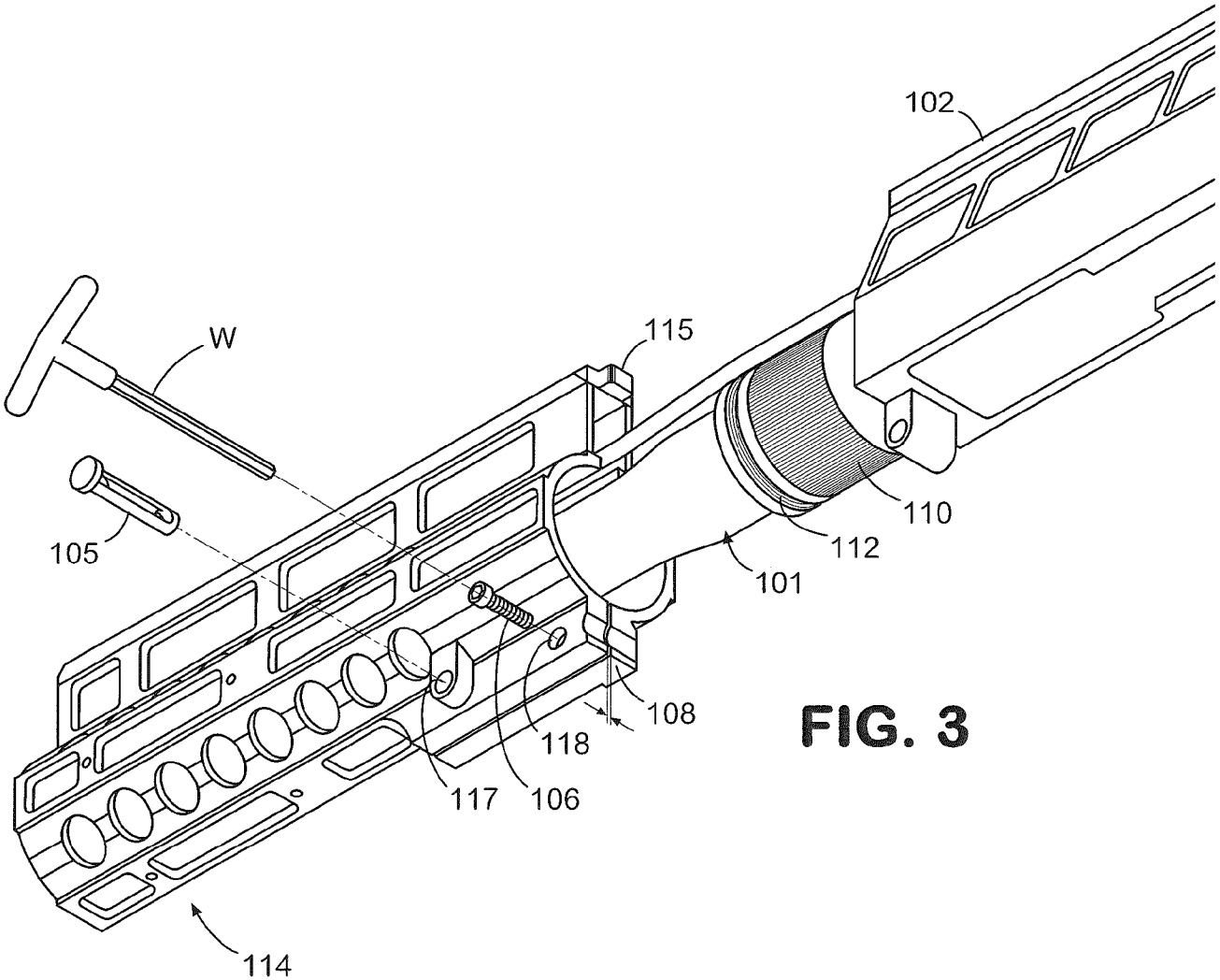
FIG. 3 is an exploded perspective showing the detail of the attachment of the upper receiver assembly to the barrel assembly as depicted in FIG. 2, in accordance with one exemplary embodiment of the present invention.

FIG. 3 is another perspective view of the joining of the barrel assembly 101, aft portion 102 of upper receiver assembly, and fore (hand guard) portion 114 of upper receiver assembly as depicted in FIGS. 1 and 2 from a different vantage point than that of FIGS. 1 and 2. With reference to FIG. 3, barrel assembly 101 is affixed to aft portion 102 of upper receiver assembly and secured by barrel nut connector sleeve 110. Fore (hand guard) portion of upper receiver assembly 114 is mounted over barrel assembly 101 by aligning alignment tab 115 on fore (hand guard) portion 114 of upper receiver assembly with alignment tab receiver compartment 116 on aft portion 102 of upper receiver assembly, further inserting take-down pin 105 into take-down pin receptacle port 117 to secure barrel nut connector sleeve 110, and inserting clamp screw 106 into slotted clamp screw receptacle port 118 to compress slotted clamp 108 and prevent barrel nut connector sleeve 110 from rotating around the longitudinal axis of barrel assembly 101.

Utilizing a barrel nut connector sleeve 110 that can be tightened by hand and secured by a simple clamp screw 108, such as, for example, a socket head hex screw, avoids the requirement for overly specialized tools or burdensome equipment, such as torque wrenches or bench vise required by prior rifle systems. Eschewing requirements for specialized tools and equipment that cannot be carried into the field allows for simple and rapid attachment, change, and detachment of the barrel assembly 101. As a result, the barrel assembly 101 can be quickly or easily removed, changed, or assembled in the field under combat conditions or exigent circumstances, and the rifle system can be quickly and easily stored in a disassembled state.

In the embodiment illustrated in FIGS. 1-3, the modular rifle system is an M-16 or AR-15 style rifle. For the purposes of this disclosure, the term "M-16 style rifle" generally refers to the M-16 automatic rifle commonly associated with the U.S. military and disclosed in U.S. Pat. No. 2,951,424, issued to Eugene M. Stoner on Sep. 6, 1960 (incorporated herein by reference in its entirety). The M16 rifle is a gas-operated rifle having a bolt and bolt carrier. Typically, the M16 is configured to fire .223 caliber rounds or other comparable rounds, such as, by way of example, 5.56×45 mm NATO rounds. The term "M-16 style rifle" also refers to variants of the M-16, which includes rifles sharing a commonality of parts with the M-16 and rifles that are derived from the M-16. One example variant of the M-16 is the AR-15 rifle, which is the semiautomatic civilian version of the M-16. Other example variants of the M-16 include rifles identified by the following appellations: XM16, XM16E1, M16A1, M16A2, M16A2E1, M16A2E2, M16A2E3, M16A2E4, M16A3, M16A4, XM177, XM177E1, XM177E2, CAR-15, M4 Carbine, M4A1 Carbine, M4E2, M4 MWS, Mk 4 Mod 0, M231, M231 FPW, KH2002, S5.56, MSSR, NORCINCO, M311/CQ, M14, M14 SMUD, GUU-5/P, Diemaco C7, Diemaco C8, SDM-R, SAM-R, Mark 11 SWS, Mark 12 SPR, SEAL Recon Rifle, Mark 18 CQBR, Ares Shrike, La France M16K, M249, XM8, MK16, FN SCAR Colt Commando, Colt Models 601, 602, 603, 604, 645, 645E, 646, 655, 656, 723, 725, 733, 920, 921, 921 HB, 925 and 945. The M-16 style rifle also refers to the AR-10/SR-25 rifle system in, for example, 7.62 mm/.308 caliber. Still other variants of the M-16 that are known now or are developed later are intended to be included within the scope of the term "M-16 style rifle," as understood by a person of skill in the art.

While particular embodiments of modular rifles and rifle systems have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims.

The invention claimed is:

1. A modular rifle system comprising:

a lower receiver assembly;

an upper receiver assembly; and a barrel assembly;

wherein the barrel assembly is releasably attached to a first portion of the upper receiver assembly by a barrel nut connector sleeve capable of being tightened by hand, the connector sleeve is prevented from becoming untightened and unconnected during firing of the rifle system by a second portion of the upper receiver assembly, and the second portion of the upper receiver assembly is releasably attached to the barrel assembly and the first portion of the upper receiver assembly, wherein the second portion of the upper receiver assembly is releasably attached to the barrel nut connector sleeve by means of a take-down pin inserted through the second portion of the upper receiver assembly and engaging is receptacle groove in the barrel nut connector sleeve; and wherein the second portion of the upper receiver assembly is releasably coupled to the first portion of the upper receiver assembly by means of an alignment tab and an alignment tab receptacle, wherein the second portion of the upper receiver is prevented from rotating during firing of the rifle system by coupling of the alignment tab and alignment tab receptacle.

2. A modular rifle system comprising:

a lower receiver assembly;

an upper receiver assembly; and a barrel assembly;

wherein the barrel assembly is releasably attached to a first portion of the upper receiver assembly by a barrel nut connector sleeve capable of being tightened by hand, the connector sleeve is prevented from becoming untightened and unconnected during firing of the rifle system by a second portion of the upper receiver assembly, and the second portion of the upper receiver assembly is releasably attached to the barrel assembly and the first portion of the upper receiver assembly, wherein the second portion of the upper receiver assembly is releasably attached to the barrel nut connector sleeve by means of a take-down pin inserted through the second portion of the upper receiver assembly and engaging is receptacle groove in the barrel nut connector sleeve; and wherein the second portion of the upper receiver assembly is releasably attached to the barrel nut connector sleeve by means of a slotted screw clamp, wherein compression of the screw clamp on the barrel nut connector sleeve prevents the barrel nut connector sleeve from rotating during firing of the rifle system.

3. The modular rifle system of claim 1, wherein the second portion of the upper receiver assembly is releasably attached to the barrel nut connector sleeve by means of a slotted screw clamp, wherein compression of the screw clamp on the barrel nut connector sleeve prevents the barrel nut connector sleeve from rotating during firing of the rifle system.

4. The modular rifle system of claim 3, wherein the rifle system is an M-16 or AR-15 style rifle system.

5. A modular rifle system comprising:

a lower receiver assembly;

an upper receiver assembly having a first portion and a second portion; and a barrel assembly, consisting of a barrel and a hand-tiqhtenable barrel nut connector sleeve;

wherein the barrel assembly is releasably attached to the upper receiver assembly by:

the hand-tightenable barrel nut connector sleeve releasably connecting the barrel assembly to the first portion of the upper receiver;

the second portion of the upper receiver assembly releasably attaching to the barrel nut connector sleeve and the first portion of the upper receiver assembly, wherein the second portion of the upper receiver assembly secures the barrel nut connector sleeve by means of applied pressure, preventing the barrel nut sleeve from rotating and the second portion of the upper receiver assembly from becoming detached when the rifle system is fired, wherein the second portion of the upper receiver assembly is releasably attached to the barrel nut connector sleeve by means of a take-down pin inserted through the second portion of the upper receiver assembly and engaging a receptacle groove in the barrel nut connector sleeve; and wherein the second portion of the upper receiver assembly is releasably coupled to the first portion of the upper receiver assembly by means of an alignment tab and an alignment tab receptacle, wherein the second portion of the upper receiver is prevented from rotating during firing of the rifle system by coupling of the alignment tab and alignment tab receptacle.

6. The modular rifle system of claim 5, wherein the second portion of the upper receiver assembly is releasably attached to the barrel nut connector sleeve by means of a slotted screw clamp, wherein compression of the screw clamp on the barrel nut connector sleeve prevents the barrel nut connector sleeve from rotating during firing of the rifle system.

7. The modular rifle system of claim 6, wherein the rifle system is an M-16 or AR-15 style rifle system.

8. A method of assembling and disassembling a barrel of a modular rifle system having an upper receiver assembly and a removable barrel assembly, comprising the steps of:

aligning the barrel assembly with a first portion of the upper receiver;

releasably affixing the barrel assembly to the first portion of the upper receiver assembly;

releasably securing affixment of the barrel assembly by means of a hand-tightenable barrel nut connector sleeve;

aligning a second portion of the upper receiver assembly with the first portion of the upper receiver assembly;

releasably connecting the first and the second portion of the upper receiver assembly;

releasably attaching the second portion of the upper receiver assembly to the barrel nut connector sleeve, wherein the second portion of the upper receiver assembly secures the barrel nut connector sleeve from rotating and the second portion of the upper receiver assembly from becoming detached during firing of the rifle system, wherein the barrel assembly is releasably secured to the first portion of the upper receiver assembly by threading the barrel nut connector sleeve onto a threaded nipple on the forward face of the first portion of the upper receiver assembly and tightened by hand to secure the barrel assembly to the first portion of the upper receiver assembly;

wherein the second portion of the upper receiver assembly is releasably coupled to the first portion of the upper receiver assembly by aligning and inserting an alignment tab on one portion of the upper receiver assembly into an alignment tab receptacle on the other portion of the upper receiver assembly, wherein the second portion of the upper receiver is prevented from rotating during firing of the rifle system by coupling of the alignment tab and the alignment tab receptacle; and wherein attaching the second portion of the upper receiver to the barrel nut connector sleeve is accomplished by inserting a removable pin through the second portion of the upper receiver assembly, in which the pin engages a receptacle groove integrated into the outer diameter of the barrel nut connector sleeve.

9. The modular rifle assembly/disassembly method of claim 8, wherein the second portion of the upper receiver assembly is releasably attached to the barrel nut connector sleeve by tightening a slotted screw clamp around the outer diameter of the barrel nut connector sleeve, wherein compression of the screw clamp on the barrel nut connector sleeve prevents the barrel nut sleeve from rotating during firing of the rifle system.

10. The modular assembly/disassembly method of claim 9, wherein the rifle system assembled/disassembled is an M-16 or AR-15 style rifle system.

* * * * *